US011493268B2

(12) United States Patent
Ryu

(10) Patent No.: US 11,493,268 B2
(45) Date of Patent: Nov. 8, 2022

(54) REFRIGERATOR APPLIANCE HAVING A WEIGHT-DETECTING DRAWER ASSEMBLY

(71) Applicant: Haier US Appliance Solutions, Inc., Wilmington, DE (US)

(72) Inventor: Choon Jae Ryu, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/173,336

(22) Filed: Feb. 11, 2021

(65) Prior Publication Data

US 2022/0252338 A1 Aug. 11, 2022

(51) Int. Cl.
*F25D 29/00* (2006.01)
*F25D 25/02* (2006.01)

(52) U.S. Cl.
CPC ..... *F25D 29/005* (2013.01); *F25D 25/025* (2013.01); *F25D 2500/06* (2013.01); *F25D 2700/06* (2013.01)

(58) Field of Classification Search
CPC ..... F25D 29/00; F25D 29/005; F25D 25/025; F25D 2500/06; F25D 2325/00; F25D 2700/06
See application file for complete search history.

(56) References Cited

U.S. PATENT DOCUMENTS 8,015,839 B2 * 9/2011 Kang ..... F25D 17/08 62/409
9,719,720 B2 * 8/2017 Seo ..... F25D 29/00
10,389,980 B2 * 8/2019 Izawa ..... H04N 5/44
10,415,875 B2 * 9/2019 Biotti ..... F25D 25/025
10,753,673 B2 * 8/2020 Sert ..... F25C 1/25
2013/0127323 A1 * 5/2013 Seo ..... F25D 23/00 312/404
2013/0257253 A1 * 10/2013 Haltmeyer ..... F25D 25/025 312/404

(Continued)

FOREIGN PATENT DOCUMENTS

DE 202008015892 U1 3/2009
JP 2002303479 A * 10/2002 ..... F25D 29/00

(Continued)

OTHER PUBLICATIONS

Translation JP2013011383A, 7 pages (Year: 2013).*
Translation JP2018095450A, 47 pages (Year: 2018).*

*Primary Examiner* — Andrew M Roersma
(74) *Attorney, Agent, or Firm* — Dority & Manning, P.A.

(57) ABSTRACT

A refrigerator appliance may include a cabinet, a door, an image module, and a drawer assembly. The cabinet may include an inner liner defining a chilled chamber. The door may be rotatably hinged to the cabinet to provide selective access to the chilled chamber. The image module may be mounted to the cabinet and have a field of view within the chilled chamber. The drawer assembly may be disposed within the field of view of the image module. The drawer assembly may include an assembly frame supported on the inner liner, a slidable drawer movably attached to the assembly frame to move relative thereto, and a plurality of weight sensors mounted on the assembly frame apart from the slidable drawer to detect a weight of one or more objects received on the drawer assembly.

18 Claims, 7 Drawing Sheets

(56) References Cited

U.S. PATENT DOCUMENTS

| | | | | |
|---|---|---|---|---|
| 2016/0123657 | A1* | 5/2016 | Kim | H04N 5/2257<br>62/125 |
| 2017/0115051 | A1* | 4/2017 | Ramm | F25D 25/025 |
| 2017/0122653 | A1* | 5/2017 | Cizik | F25D 17/042 |

FOREIGN PATENT DOCUMENTS

| | | | | |
|---|---|---|---|---|
| JP | 2013011383 | A | 1/2013 | |
| JP | 2018084358 | A | 5/2018 | |
| JP | 2018095450 | A | 6/2018 | |
| KR | 20140127590 | | 11/2014 | |
| WO | WO-2021032482 | A1 * | 2/2021 | F25D 29/00 |

* cited by examiner

REFRIGERATOR APPLIANCE HAVING A WEIGHT-DETECTING DRAWER ASSEMBLY

FIELD OF THE INVENTION

The present subject matter relates generally to refrigerator appliances, and more particularly to refrigerator appliances having features for detecting the weight of items supported on a drawer assembly.

BACKGROUND OF THE INVENTION

Storage enclosures, such as refrigerator appliances and pantries, generally provide an enclosed chamber for receiving multiple items or objects. For example, refrigerator appliances generally include a cabinet that defines a chilled chamber. A user can place food items or objects within the chilled chamber in order to hinder perishing of such food items. Thereby, a useable life of perishable items or objects can be increased.

Over time, a large volume or number of stored items (e.g., food items) can accumulate within the refrigerator's chilled chamber. As stored items accumulate, users of the refrigerator appliance can have difficulty identifying the items located within the refrigerator appliance. Additionally, users can have difficulty determining a quantity of certain items within the refrigerator appliance. This is especially true when multiple users add/remove items from a common refrigerator appliance without communicating with other users. Consequently, the users may accidentally purchase undesired items or fail to purchase items that are nearly finished. For instance, items, such as liquids or produce, are stored within containers that are difficult for a user to see inside. Such items may be used irregularly and partially so that the entire contents of a container are only emptied after multiple uses. Additionally or alternatively, some users may be unaware that certain items have been removed or consumed. As a result, a user may be unable to determine when the container is nearly empty and in need of replacing.

Some existing appliances have attempted to address these issues by requiring a user to manually input each item being stored. Other appliances have used various methods, such as scales, to estimate or guess the quantity or identification of items being stored. Nonetheless, such attempts have been insufficiently cumbersome or expensive. For instance, typical scales require various wires to be routed to a specific shelf or region of the appliance. If multiple scales or weight-sensing regions are desired, additional wires and connections are obviously required. As a result, the complexity and cost associated with detecting the weight of loads is significant. Additionally or alternative, typical scales are only able to determine the weight of the particular shelf or area of the appliance. As a result, the complexity and cost associated with detecting the weight of objects within, for instance, multiple drawers is significant. Moreover, even once a weight is detected, conventional systems require a user to manually input or know what items are being weighed, which can be difficult or cumbersome.

Accordingly, a refrigerator appliance with features for assisting a user with tracking contents of a chilled chamber of the refrigerator appliance would be useful. In particular, a refrigerator appliance with features for assisting a user with accurately tracking the amount or volume of contents of a chilled chamber of the refrigerator appliance without significantly complicating assembly or operation (e.g., across multiple drawers) would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a door, an image module, and a drawer assembly. The cabinet may include an inner liner defining a chilled chamber. The door may be rotatably hinged to the cabinet to provide selective access to the chilled chamber. The image module may be mounted to the cabinet and have a field of view within the chilled chamber. The drawer assembly may be disposed within the field of view of the image module. The drawer assembly may include an assembly frame supported on the inner liner, a slidable drawer movably attached to the assembly frame to move relative thereto, and a plurality of weight sensors mounted on the assembly frame apart from the slidable drawer to detect a weight of one or more objects received on the drawer assembly.

In another exemplary aspect of the present disclosure, a refrigerator appliance is provided. The refrigerator appliance may include a cabinet, a door, an image module, and a drawer assembly. The cabinet may include an inner liner defining a chilled chamber. The door may be rotatably hinged to the cabinet to provide selective access to the chilled chamber. The image module may be mounted to the cabinet and have a field of view within the chilled chamber. The drawer assembly may be disposed within the field of view of the image module. The drawer assembly may include an assembly frame supported on the inner liner, a first slidable drawer movably attached to the assembly frame to move relative thereto, a second slidable drawer movably attached to the assembly frame apart from the first slidable drawer to move relative to the assembly frame and first slidable drawer, a horizontal platform attached to the assembly frame above the first and second slidable drawers, and a plurality of weight sensors mounted on the assembly frame apart from the first and second slidable drawers to detect a weight of one or more objects received on the drawer assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
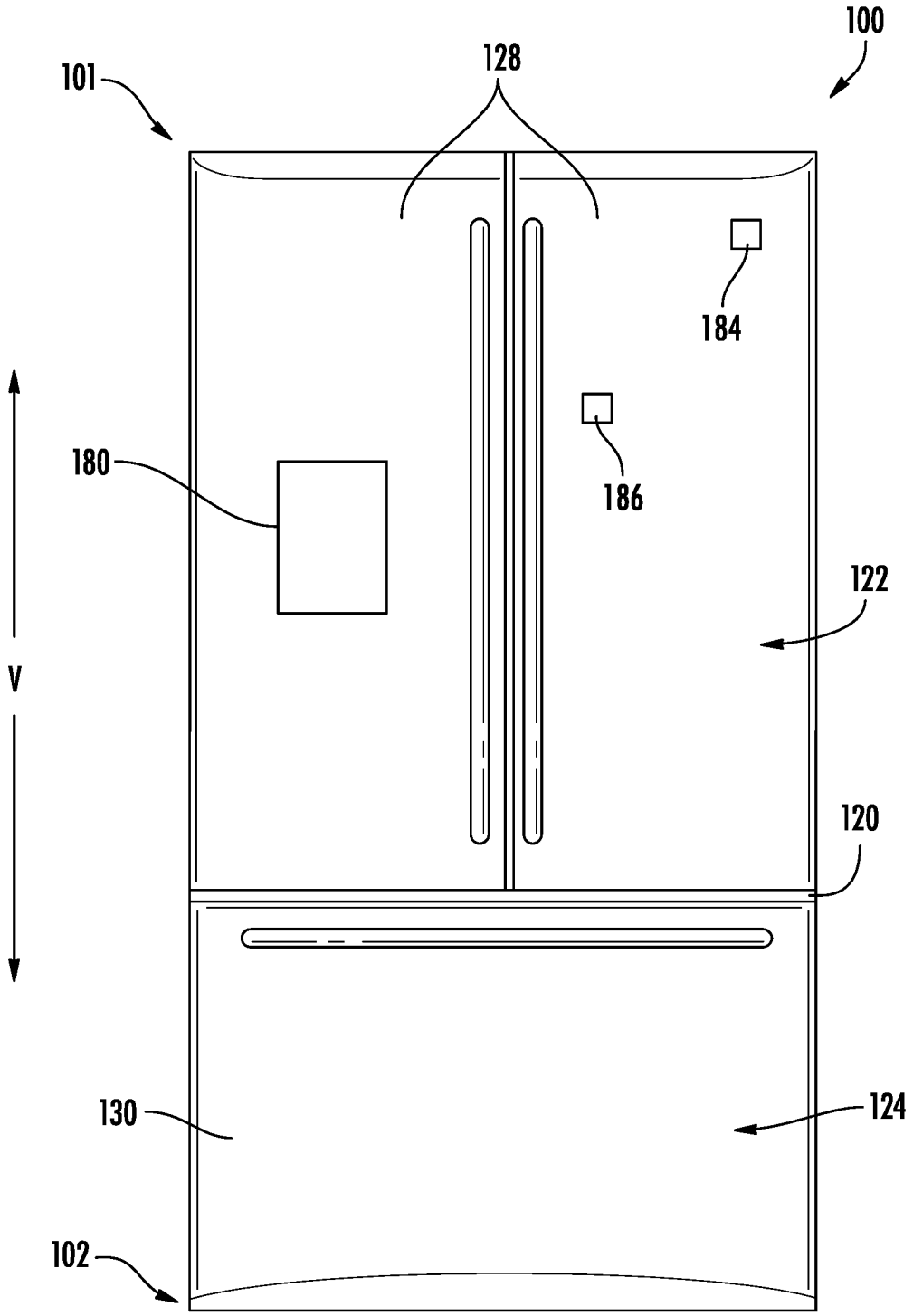
FIG. 1 provides a front elevation view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
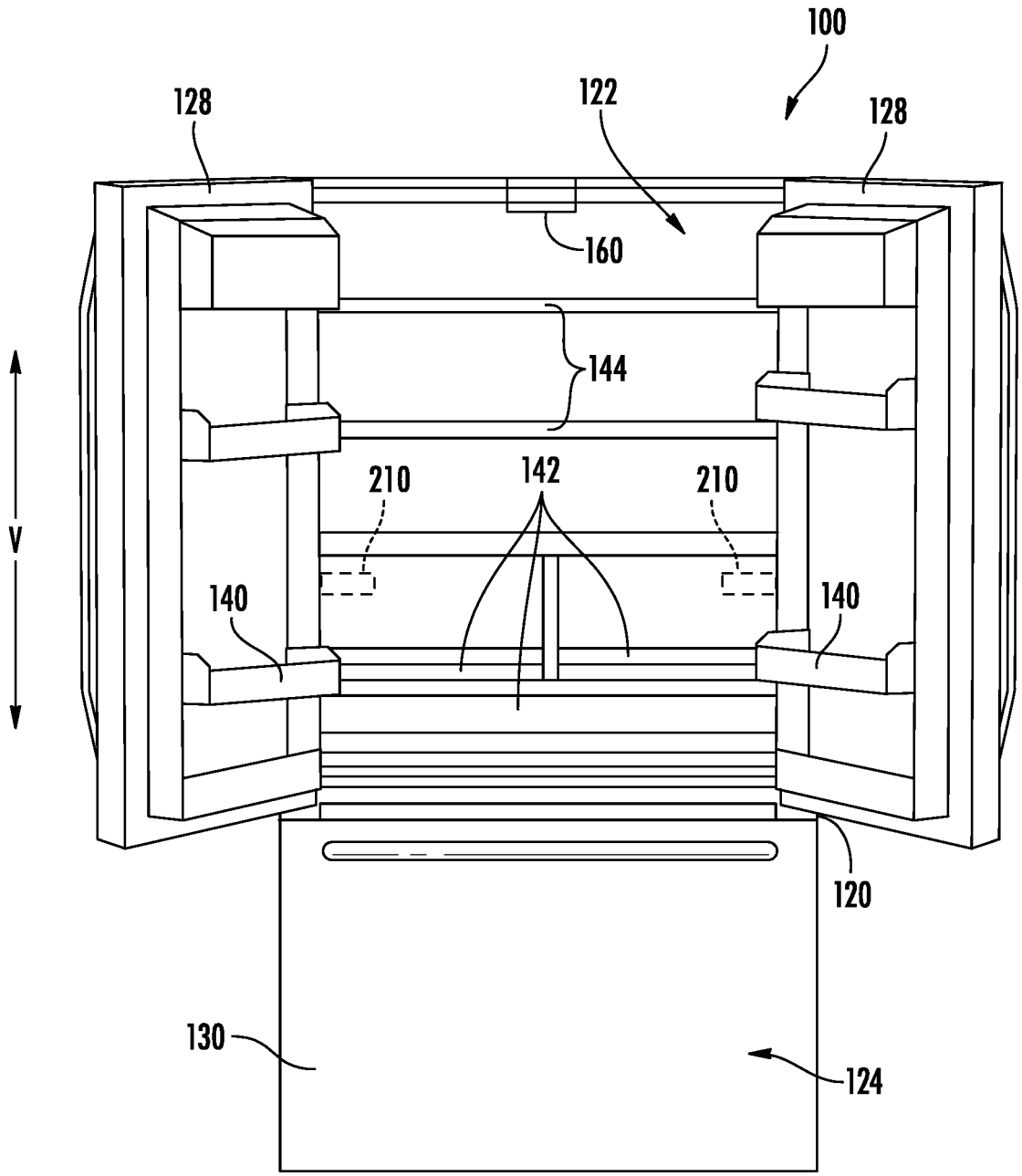
FIG. 2 provides a front elevation view of a refrigerator appliance according to exemplary embodiments of the present disclosure, wherein refrigerator doors are shown in an open position.

Turning now to the figures, FIG. 1 provides a front elevation view of a refrigerator appliance 100 according to exemplary embodiments of the present disclosure with refrigerator doors 128 of the refrigerator appliance 100 shown in a closed position. FIG. 2 provides a front view elevation of refrigerator appliance 100 with refrigerator doors 128 shown in an open position to reveal a fresh food chamber 122 of refrigerator appliance 100.

Refrigerator appliance 100 includes a housing or cabinet 120 that extends between a top 101 and a bottom 102 along a vertical direction V. Cabinet 120 defines chilled chambers for receipt of food items for storage. In particular, cabinet 120 defines fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of storage enclosure, such as a top mount refrigerator appliance, a side-by-side style refrigerator appliance, or an unrefrigerated pantry enclosure. Consequently, the description set forth herein is for illustrative purposes only and is not intended to be limiting in any aspect to any particular storage enclosure or refrigerator chamber configuration.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer 142 (not shown) slidably mounted within freezer chamber 124. As discussed above, refrigerator doors 128 and freezer door 130 are shown in the closed configuration in FIG. 1, and refrigerator doors 128 are shown in the open position in FIG. 2.

Turning now to FIG. 2, various storage components are mounted within fresh food chamber 122 to facilitate storage of food items therein as will be understood by those skilled in the art. In particular, the storage components include bins 140, drawers 142, and shelves 144 that are mounted within fresh food chamber 122. Bins 140, drawers 142, and shelves 144 are configured for receipt of stored items (e.g., beverages or solid food items) and may assist with organizing such food items. As an example, drawers 142 can receive fresh food items (e.g., vegetables, fruits, or cheeses) and increase the useful life of such fresh food items. As will be described in greater detail below, one or more shelves 144 or drawers 142 may be included with or as part of a drawer assembly 200 mounted to an inner liner of fresh food chamber 124.

Refrigerator appliance 100 also includes features for assisting a user with identifying food items positioned within fresh food chamber 122 or freezer chamber 124. The user can utilize such features, for example, to view food items stored (i.e., stored items) within fresh food chamber 122 or freezer chamber 124 or create an inventory of such stored items. Such features are discussed in greater detail below.

Figure 3:
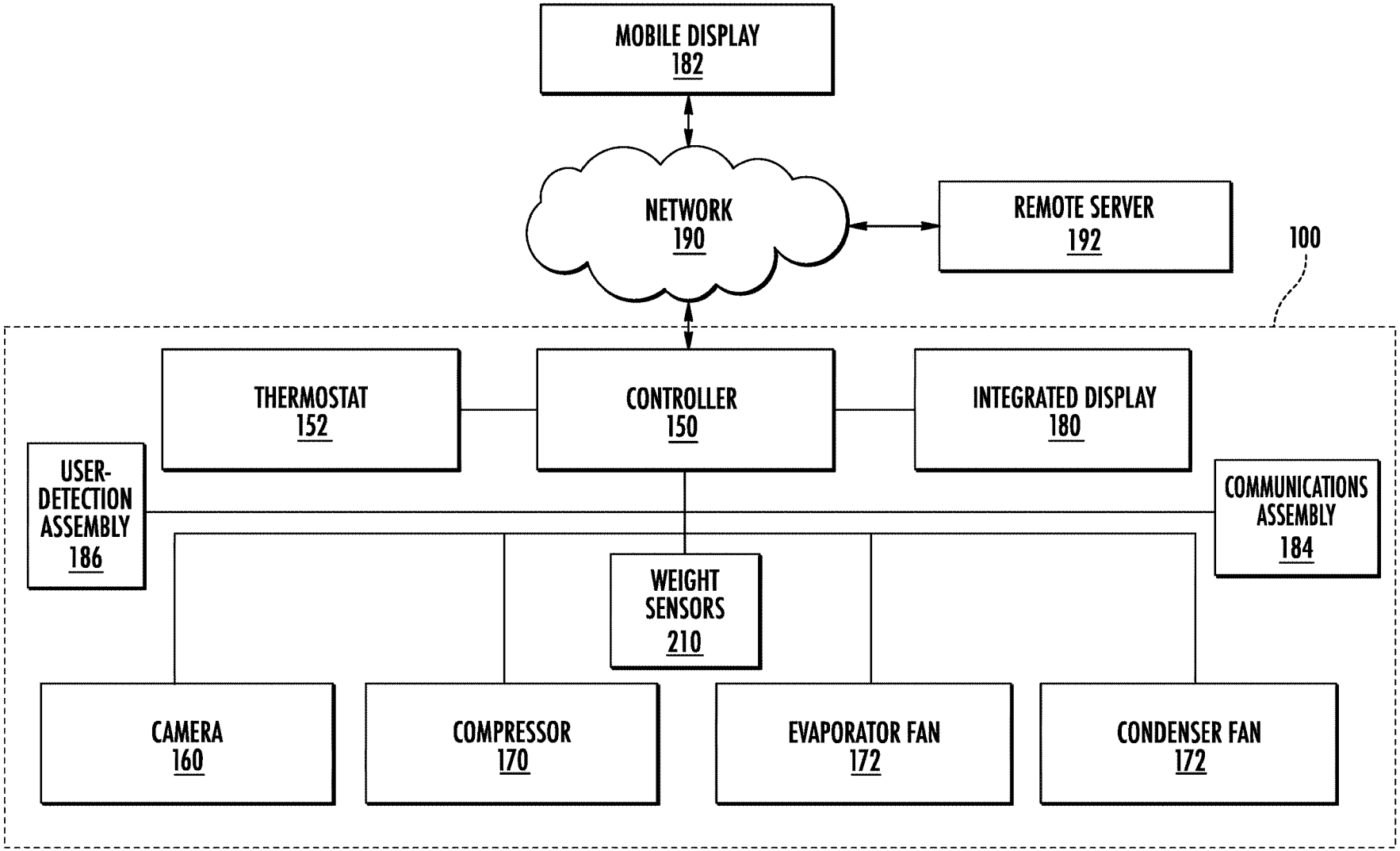
FIG. 3 provides a schematic view of a refrigerator appliance according to exemplary embodiments of the present disclosure.

FIG. 3 provides a schematic view of refrigerator appliance 100.

Refrigerator appliance 100 includes a controller 150 that is operatively coupled or in communication with components of a refrigeration system (not shown) of refrigerator appliance 100 configured for cooling fresh food chamber 122 or freezer chamber 124. The components include a compressor 170, an evaporator fan 172, and a condenser fan 174. Controller 150 can selectively operate such components in order to cool fresh food chamber 122 or freezer chamber 124. Controller 150 is also in communication with a thermostat (e.g., a thermocouple or thermistor). The thermostat may be positioned in fresh food compartment 122 or freezer compartment 124 (FIG. 2). Controller 150 may receive a signal from the thermostat that corresponds to a temperature of fresh food compartment 122 or freezer compartment 124. Controller 150 may also include an internal timer for calculating elapsed time periods.

Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes non-transitory programming instructions stored in memory. For certain embodiments, the instructions include a software package configured to operate appliance 100 or execute an operation routine (. The memory may be a separate component from the processor or may be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 150 may be positioned in a variety of locations throughout refrigerator appliance 100. Input/output ("I/O") signals may be routed between controller 150 and various operational components of refrigerator appliance 100. One or more components of refrigerator appliance 100 may be in communication (e.g., electric communication) with controller 150 via one or more conductive signal lines or shared communication busses. Additionally or alternatively, one or more components of refrigerator appliance 100 may be in communication (e.g., wireless communication) with controller 150 via one or more wireless signal bands.

In some embodiments, refrigerator appliance 100 also includes a camera or image module 160. Image module 160 may be any type of device suitable for capturing a two-dimensional picture or image. As an example, image module 160 may be a video camera or a digital camera with an electronic image sensor [e.g., a charge coupled device (CCD) or a CMOS sensor]. As an additional or alternative example, image module 160 may include a pressure-sensing mat including a plurality of pressure detection cells to detect the relative variations in pressure, as would be understood. The pressure-sensing mat may be disposed on one or more shelves 144 and, optionally, be formed from a substantially transparent material. Thus, the pressure-sensing mat may detect one or more objects placed on the corresponding shelf or shelves 144. Moreover, a two-dimensional image (e.g., of the footprint for one or more objects placed on the corresponding shelf 144) may be assembled using the signals received from the pressure-sensing mat. As a further additional or alternative example, image module 160 may include a beam-emission sensor (e.g., lidar, radar, etc.) to detect objects within a line of sight or transmission of the sensor, as would be understood.

When assembled, image module 160 is in communication (e.g., electric or wireless communication) with controller 150 such that controller 150 may receive a signal from image module 160 corresponding to the image captured by image module 160.

Generally, image module 160 is positioned on refrigerator appliance 100. In some embodiments, image module 160 is mounted within fresh food chamber 122 at a top portion thereof (e.g., adjacent top 101). For instance, image module 160 may be fixed to or directed through a top wall of an internal liner defining fresh food chamber 122. In such embodiments, image module 160 may be directed downward, as illustrated in FIG. 2.

In certain embodiments, image module 160 is directed toward one or more chilled chamber (e.g., fresh food chamber 122—FIG. 2). For instance, image module 160 may be directed towards at least a portion of any particular one of or combination of drawers 142 and shelves 144 (FIG. 2). Thus, in some such embodiments, image module 160 can capture images of one of drawers 142, all of drawers 142, one of shelves 144, all of shelves 144, or any suitable combination thereof.

Although image module 160 is illustrated as being mounted within fresh food chamber 122, it is understood that additional or alternative embodiments include a camera or image module [e.g., digital camera with an electronic image sensor, such as a charge coupled device (CCD) or a CMOS sensor; a pressure-sensing mat; a beam emitting sensor; etc.] mounted at another suitable portion of refrigerator appliance, such as a door 128. Such a camera assembly may be directed outward or in front of refrigerator appliance 100 and may thus capture images of a user or area positioned forward from refrigerator appliance 100 (e.g., when the corresponding door is in a closed position).

In certain embodiments, refrigerator appliance 100 includes an integrated display 180. Integrated display 180 may be mounted on refrigerator door 128 (FIG. 1) or at any other suitable location on refrigerator appliance 100. Integrated display 180 is in communication with controller 150 such that integrated display 180 may receive a signal from controller 150 corresponding to an image captured by image module 160. Integrated display 180 can receive such signal from controller 150 and present the image to a user visually. Integrated display 180 may include, for example, a liquid crystal display panel (LCD), a plasma display panel (PDP), or any other suitable mechanism for displaying an image (e.g., a projector).

Separate from or in addition to integrated display 180, refrigerator 100 may include a communications assembly 184 in communication with controller 150. Generally, communications assembly 184 may be mounted on any suitable portion of refrigerator 100, such as within cabinet 120 or a door 128. In certain embodiments, the communications assembly includes a loudspeaker (e.g., dynamic loudspeaker, electrostatic loudspeaker, planar magnetic loudspeaker, piezoelectric loudspeaker etc.). As is understood, the loudspeaker may be configured to generate soundwaves from one or more electrical signals (e.g., digital sound signals received from controller 150). The loudspeaker may thus audibly communicate information to a user. In additional or alternative embodiments, the communications assembly includes a microphone (e.g., dynamic microphone, ribbon microphone, fiber-optic microphone, piezoelectric microphone, etc.). As is understood, the microphone may generate one or more electrical signals (e.g., to be received by controller 150) from one or more received soundwaves (e.g., from a user). The microphone may thus receive audible prompts or commands from a user that can be directed to the controller 150.

In exemplary embodiments, refrigerator appliance 100 includes a network interface (not shown) that couples refrigerator appliance 100 (e.g., controller 150) to a network 190 such that refrigerator appliance 100 can transmit and receive information over network 190. Network 190 can be any wired or wireless network such as a WAN, LAN, or HAN.

In optional embodiments, refrigerator appliance 100 includes a user-detection assembly 186. Generally, user-detection assembly 186 includes one or more sensors configured to detect a biometric or personalized marker corresponding to a specific individual user. As an example, user-detection assembly 186 may include a forward-facing camera configured to recognize or identify a user's face based on a captured two-dimensional image. As another example, user-detection assembly 186 may include a fingerprint imaging sensor configured to visually detect a user's fingerprint. As yet another example, user-detection assembly 186 may include a signal-detection sensor configured to detect a device address over a wireless communications band (e.g., a BLE band using short-wavelength UHF radio waves in the ISM band from 2.4 to 2.485 GHz). The device address may be a programmed Bluetooth address of, for instance, mobile display 182. The user-detection assembly 186 may thus determine if and when a mobile display 182 is within close proximity to refrigerator appliance 100.

In certain embodiments, image module 160 is included as part of user-detection assembly 186. As an example, user-detection assembly 186 may be configured to recognize or identify a user from a two-dimensional image captured at image module 160. In some such embodiments, controller 150 is further configured to recognize one or more defining features below a user's elbow, such as skin tone, arm/hand size, jewelry, typical clothing, etc. As is understood, recognizing such defining features may be performed by edge matching, divide-and-conquer search, greyscale matching, histograms of receptive field responses, or another suitable routine (e.g., executed at the controller 150 based on one or more captured images from image module 160).

During use, such as during an image capture sequence, image module 160 may capture one or more two-dimensional images (e.g., as a video feed or series of sequential static images) that may be transmitted to the controller 150 (e.g., as a data signal), as is generally understood. Optionally, the image capture sequence may be initiated by a predetermined user action, such as opening a door 128, detected movement within a chilled chamber (e.g., fresh food chamber 122), engaging or moving within range of user-detection assembly 186, proving a user input at communications assembly 184 or integrated display 180, etc.

One or more weight sensors 210 may be further provided within fresh food chamber 122 or freezer chamber 124, as will be described in greater detail below. Generally, weight sensor 210 is provided as or includes any suitable electronic load sensor or cell configured to generate one or more electronic signals according (e.g., in proportion to) a load thereon. For instance, weight sensor 210 may include a suitable strain gauge, force sensitive resistor, capacitance sensor, hydraulic sensor (e.g., having a deformable hydraulic tube), or pneumatic sensor (e.g., having a deformable pneumatic tube)—as would be understood.

In some embodiments, one or more remote servers 192, such as a web server, is in operable communication with controller 150. The remote server 192 can be used to host a retailer's point of sale system. In other words, remote server 192 may be or include a retailer point of sale server that tracks, for example, an identifier and quantity of purchased items, a time or date stamp of purchased items, pricing of purchased items, a customer identifier (i.e., an identifier of the purchasing customer), etc. Additionally or alternatively, the remote server 192 can be used to host a retailer's stock management system. In other words, remote server 192 may include, or be provided as, a retailer stock management server that tracks, for example, stocking data relating to items offered for sale by a retailer (e.g., expiration data, location data, cost data, etc.). Also additionally or alternatively, the remote server 192 can be used to host one or more information databases.

The remote server 192 can be implemented using any suitable computing device(s). The remote server 192 may include one or more processors and one or more memory devices (i.e., memory). The one or more processors can be any suitable processing device (e.g., a processor core, a microprocessor, an ASIC, a FPGA, a microcontroller, etc.) and can be one processor or a plurality of processors that are operatively connected. The memory device can include one or more non-transitory computer-readable storage mediums, such as RAM, ROM, EEPROM, EPROM, flash memory devices, magnetic disks, etc., and combinations thereof. The memory devices can store data and instructions which are executed by the processor to cause remote server 192 to perform operations. For example, instructions could be instructions for receiving/transmitting point of sale data signals, receiving/transmitting inventory management data signals, receiving/transmitting data signals relating to a stored item, etc.

The memory devices may also include data, such as point of sale data, customer identification data, inventory data, expiration data, etc., that can be retrieved, manipulated, created, or stored by processor. The data can be stored in one or more databases. The one or more databases can be connected to remote server 192 by a high bandwidth LAN or WAN, or can also be connected to remote server 192 through network 502. The one or more databases can be split up so that they are located in multiple locales.

Remote server 192 includes a network interface such that remote server 192 can connect to and communicate over one or more networks (e.g., network 190) with one or more network nodes. In turn, remote server 192 can exchange data with one or more nodes over the network 190. In particular, remote server 192 can exchange data with controller 150. Although not pictured, it is understood that remote server 192 may further exchange data with any number of client devices over the network 190 (e.g., mobile display 182).

Turning now generally to FIGS. 4 through 7, various views of exemplary embodiments of a drawer assembly 200 are provided. As shown, drawer assembly 200 includes an assembly frame 214 and one or more slidable storage drawers 212 (e.g., included with or as drawers 142), along with one or more weight sensors 210. When assembled, drawer assembly 200 may be disposed at a relatively low position within a corresponding chilled chamber (e.g., fresh food chamber 122). In turn, image module 160 (FIG. 2) may be disposed above drawer assembly 200 relative to the vertical direction V.

Generally, assembly frame 214 includes a rigid body on which one or more storage drawers 212 may be supported. For instance, assembly frame 214 may include one or more slide brackets 218 for receiving a storage drawer 212. As shown, a slide bracket 218 may provide a track or channel on which a mated portion of storage drawer 212 may be received or otherwise supported. When assembled, a storage drawer 212 may thus be slidably mounted to assembly frame 214. Optionally, the slide brackets 218 may be mounted below a horizontal platform 220 disposed on or included with the rigid body of assembly frame 214. As would be understood, horizontal platform 220 may be formed from a rigid material, such as a solid polymer, glass, ceramic or metal. In some such embodiments, horizontal platform 220 may serve as a shelf for supported stored items within the corresponding chilled chamber.

In some embodiments, multiple slide brackets 218 are provided for supported multiple (e.g., independent) storage drawers 212. In turn, multiple storage drawers 212 may be included with drawer assembly 200. For instance, one storage drawer 212 may be slidably mounted beside or laterally spaced apart from another storage drawer 212. Additionally or alternatively, one storage drawer 212 may be slidably mounted above or vertically spaced apart from another storage drawer 212 As would be understood, some or all of the storage drawers 212 of drawer assembly 200 may be slid forward/rearward (i.e., opened/closed) separately or independently from the other storage drawers 212.

As noted above, one more weight sensors 210 may be included with drawer assembly 200. Specifically, such weight sensors 210 may be mounted in mechanical communication with assembly frame 214 to detect the weight or mass supported thereon (e.g., on slidable drawers 212 or horizontal platform 220). In certain embodiments, a weight sensor 210 may be mounted below at least a portion of assembly frame 214. For instance, weight sensor 210 may be disposed below a slide bracket 218. In additional or alternative embodiments, one or more weight sensors 210 may be held between assembly frame 214 and the inner liner 202 of cabinet 120, which may define at least a portion of the corresponding chilled chamber (e.g., fresh food chamber 122).

When assembled, weight sensors 210 may be fixed relative to inner liner 202. Thus, as storage drawers 212 or assembly frame 214 are moved (e.g., within or from the fresh food chamber 122), weight sensors 210 may remain stationary. Optionally, multiple weight sensors 210 may be mounted at or adjacent to different portions of assembly frame 214. Thus, one or more of the weight sensors 210 may be spaced apart from each other. In some such embodiments, at least two weight sensors 210 are laterally spaced apart and proximal opposite lateral sides (e.g., left and right) of assembly frame 214. In additional or alternative embodiments, at least two weight sensors 210 are transversely spaced apart and proximal to opposite transverse ends (e.g., front and back) of assembly frame 214. Furthermore, discrete weight sensors 210 may be mounted at discrete corners (e.g., front right, back right, front left, and back left) of assembly frame 214 within fresh food chamber 122.

Figure 4:
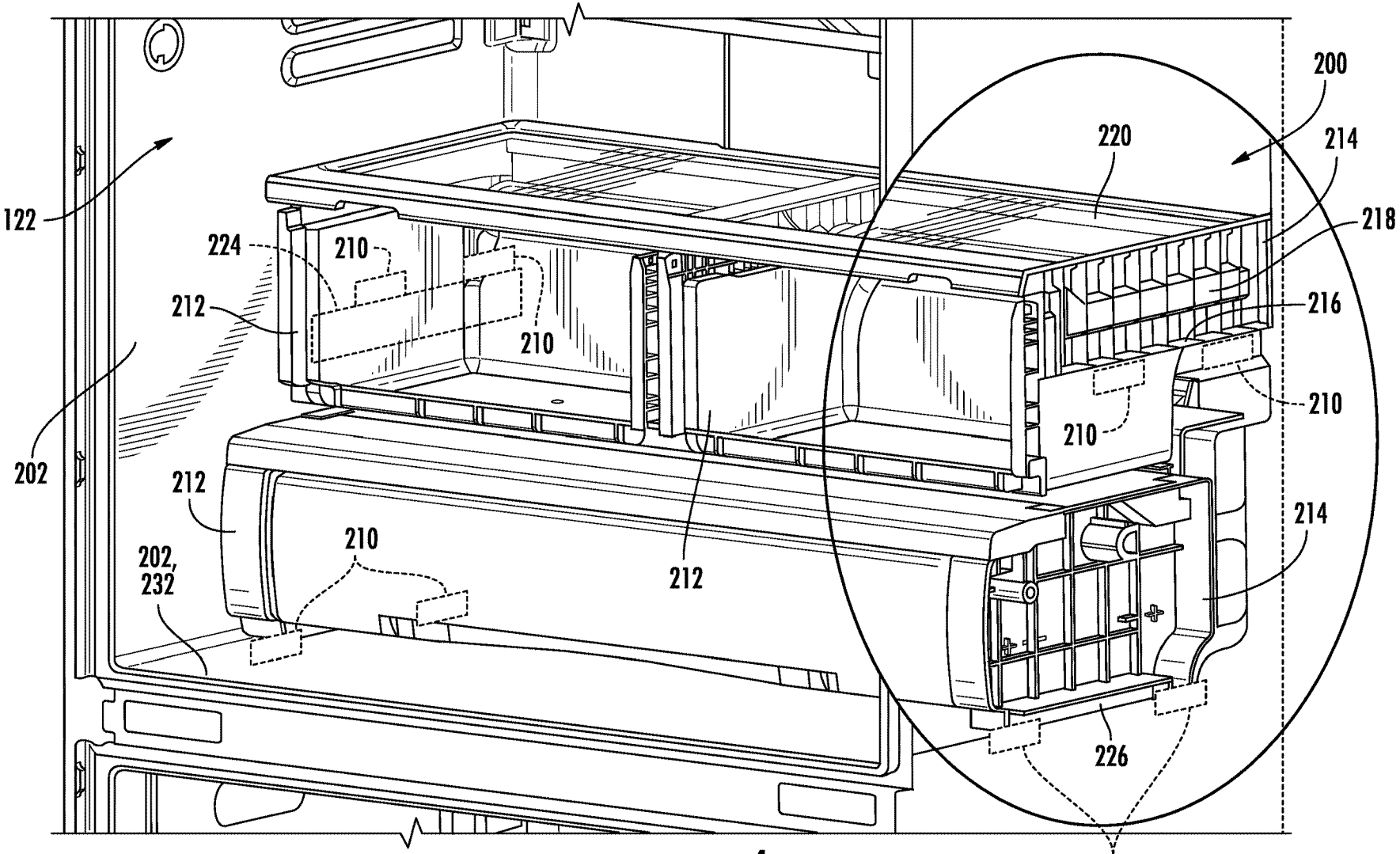
FIG. 4 provides a perspective view of a portion of a drawer assembly of a refrigerator appliance according to exemplary embodiments of the present disclosure.
Figure 5:
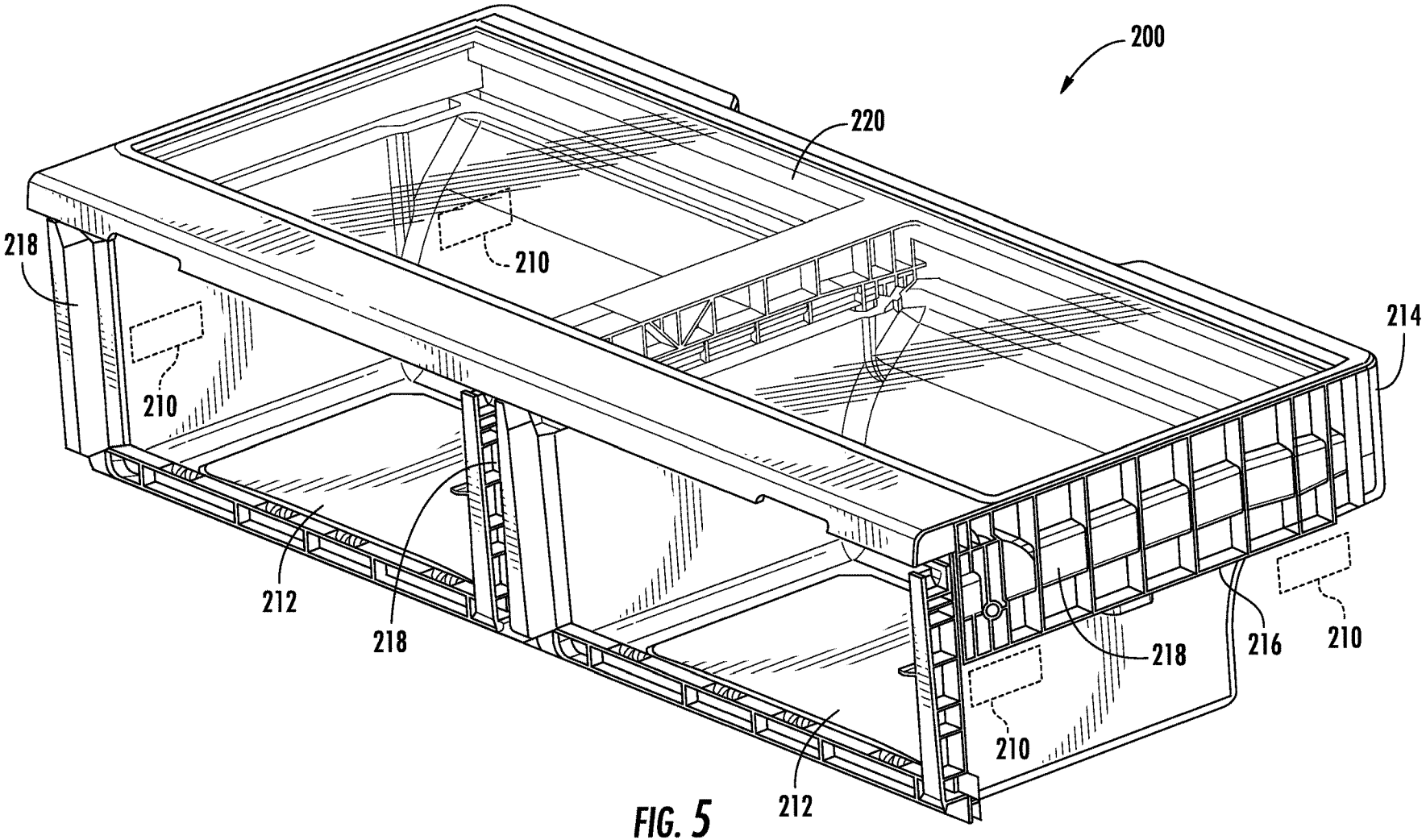
FIG. 5 provides a perspective view of a portion of a drawer assembly of a refrigerator appliance according to exemplary embodiments of the present disclosure.

Turning especially to FIGS. 4 and 5, in some embodiments, assembly frame 214 may be supported at one or more side rails 216. In particular, a pair of side rails 216 may be provided at opposite lateral sides of assembly frame 214. Such side rails 216 may be formed, for instance, below a top end of assembly frame 214. Moreover, such side rails 216 may be formed above a bottom surface of at least one storage drawer 212 supported on assembly frame 214. Thus, side rail 216 may be disposed between a top end and a bottom end of drawer assembly 200. Optionally, the side rails 216 may be disposed below the slide brackets 218.

Inner liner 202 may provide one or corresponding lateral mounts 224 on which the side rails 216 may rest. Specifically, lateral mounts 224 may be formed adjacent to each lateral side of assembly frame 214. When assembled, assembly frame 214 may be spaced apart from a base wall 232 of inner liner 202 such that assembly frame 214 "floats" within chilled chamber. In certain embodiments, weight sensors 210 are supported on the lateral mounts 224. For instance, at least one weight sensor 210 may be supported on a right lateral mount 224 while some other weight sensor 210 may be supported on a left lateral mount 224. Optionally, at least one weight sensor 210 may be as or include a strain gauge, force sensitive resistor, hydraulic tube, or pneumatic tube extending transversely along the assembly frame 214 (e.g., directly beneath a corresponding side rail 216). When assembled, assembly frame 214 may rest on the lateral mounts 224 and, thus, on top of weight sensors 210. Moreover, the force generated by the weight of stored items within the storage drawers 212 supported on assembly frame 214 may be transferred or transmitted to weight sensors 210 (e.g., at opposite lateral sides). Advantageously, weight sensors 210 may be able to detect the weight of stored items within the storage drawers 212 while being disposed outside of the same.

Figure 6:
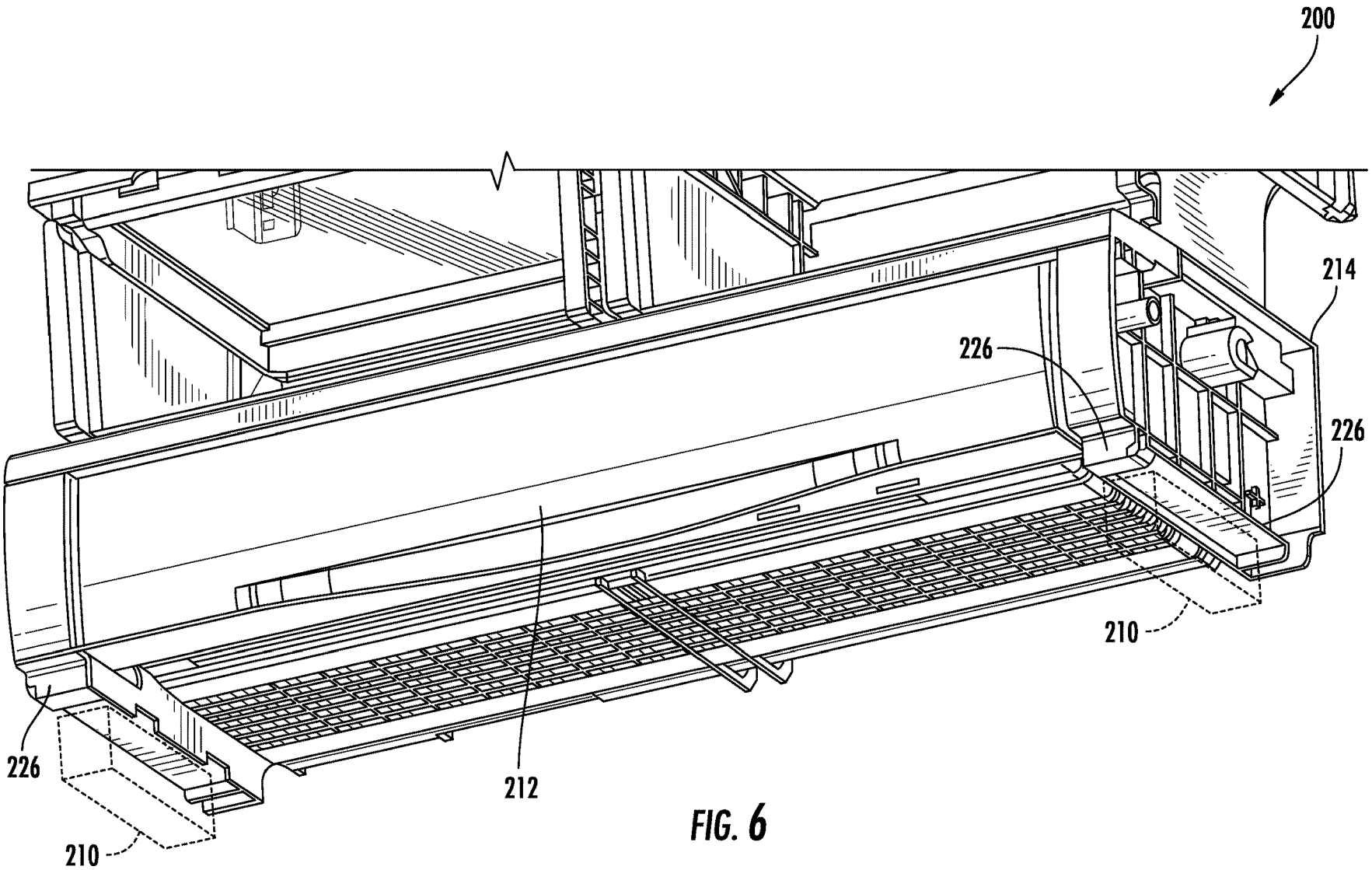
FIG. 6 provides a perspective view of a portion of a drawer assembly of a refrigerator appliance according to exemplary embodiments of the present disclosure.

Turning especially to FIGS. 4 and 6, in further embodiments, assembly frame 214 may be supported at one or more base rails 226. In particular, a pair of base rails 226 may be provided at opposite lateral sides of assembly frame 214. Such side rails 216 may be formed, for instance, at a bottom end of assembly frame 214. Moreover, such base rails 226 may be formed below a bottom surface of each storage drawer 212 supported on assembly frame 214. Thus, each storage drawer 212 may be slidably disposed between a top end and a bottom end of drawer assembly 200. Furthermore, the base rails 226 are disposed below the slide brackets 218.

Inner liner 202 may provide base wall 232 directly beneath drawer assembly 200 and on which assembly frame 214 may rest. When assembled, assembly frame 214 may thus be disposed on base wall 232 of inner liner 202. In certain embodiments, weight sensors 210 are supported on the base wall 232. For instance, at least one weight sensor 210 may be supported on base wall 232 directly beneath a right base rail 226 while some other weight sensor 210 may be supported on base wall 232 directly beneath a left base rail 226. Optionally, at least one weight sensor 210 may include or be provided as a strain gauge, force sensitive resistor, hydraulic tube, or pneumatic tube extending transversely along the assembly frame 214 (e.g., directly beneath a corresponding base rail 226). When assembled, assembly frame 214 may rest on the base wall 232 and, thus, on top of weight sensors 210. Moreover, the force generated by the weight of stored items within the storage drawers 212 supported on assembly frame 214 may be transferred or transmitted to weight sensors 210 (e.g., at opposite lateral sides). Advantageously, weight sensors 210 may be able to detect the weight of stored items within the storage drawers 212 while being disposed outside of the same.

Figure 7:
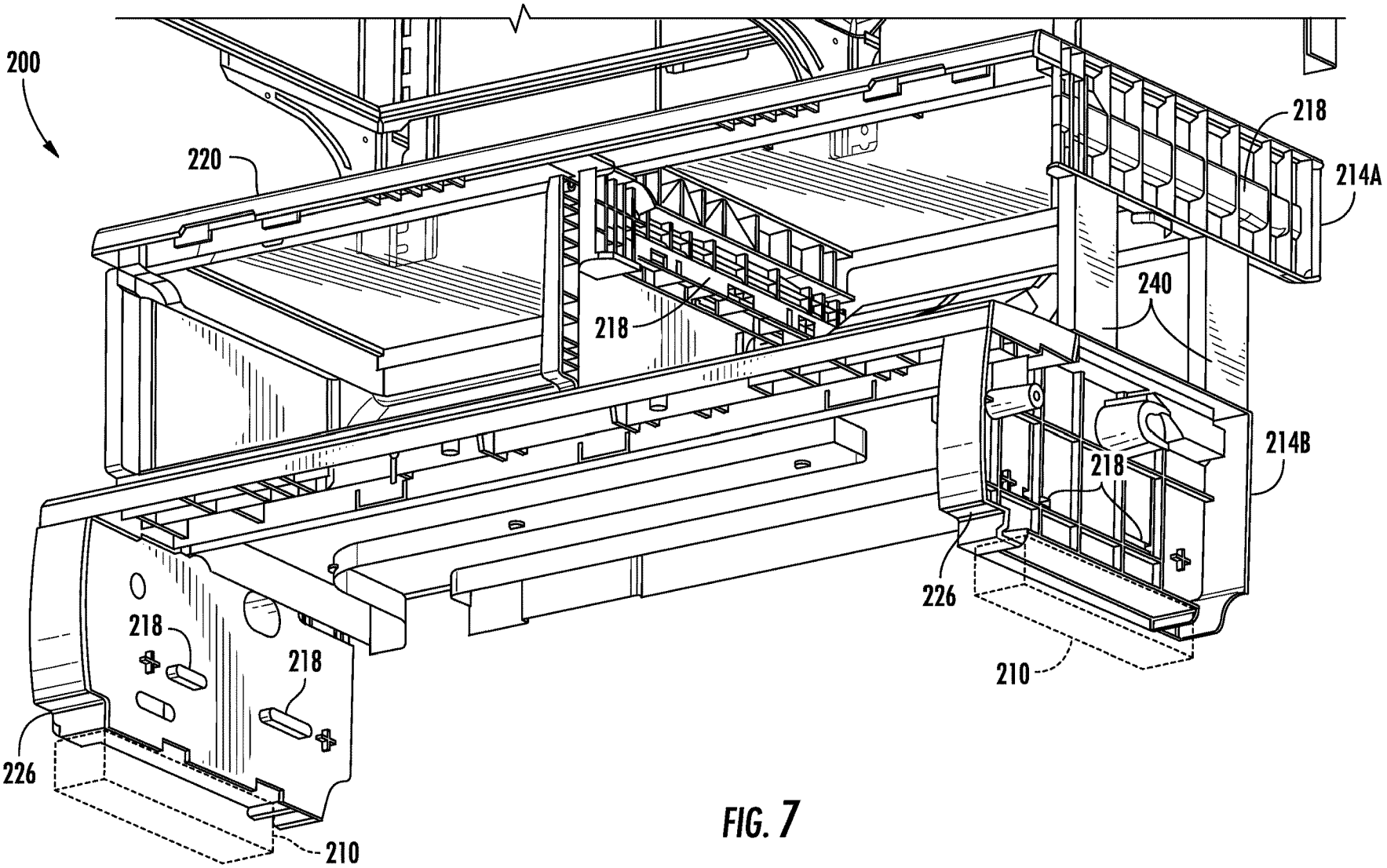
FIG. 7 provides a perspective view of a portion of a drawer assembly of a refrigerator appliance according to exemplary embodiments of the present disclosure.

Turning especially to FIG. 7, although FIGS. 4 through 6 illustrate separate assembly frames 214A, 214B spaced apart from each other and supported independently at different portions of inner liner 202, alternative embodiments may provide discrete upper and lower assembly frames 214A, 214B connected to each other and supported at a common region of inner liner 202. In some such embodiments, one or more rigid support mounts 240 extend vertically from the lower assembly frame 214 to hold or support the upper assembly frame 214A above the lower assembly frame 214B. Each of the upper and lower assembly frames 214A, 214B may slidably support one or more discrete storage drawers 212 that are, thus, vertically spaced apart from each other while being held between the top end and the bottom end of the drawer assembly 200.

As shown, weight sensors 210 be disposed on or below the lower assembly frame 214. For instance, at least one weight sensor 210 may be supported on base wall 232 directly beneath a right base rail 226 of lower assembly frame 214B while some other weight sensor 210 may be supported on base wall 232 directly beneath a left base rail 226 of lower assembly frame 214B. When assembled, lower assembly frame 214B may rest on the base wall 232 and, thus, on top of weight sensors 210. Moreover, the force generated by the weight of stored items within the storage drawers 212 supported on both assembly frames 214A, 214B may be transferred or transmitted to weight sensors 210 (e.g., at opposite lateral sides). Advantageously, weight sensors 210 may be able to detect the weight of stored items within all of the storage drawers 212 while being disposed outside of the same.

Returning generally to FIGS. 2 through 7, in certain embodiments, image module 160 and controller 150 are configured to capture one or more two-dimensional images. Optionally, multiple, sequential, two-dimensional images may be captured (e.g., at a predetermined rate or pattern) as part of an image capture sequence. Sequential images (e.g., a previously-captured image and a more-recently-captured image) may be recorded (e.g., temporarily) and compared at the controller 150. From the comparison, changes or differences between sequential images may be detected. Optionally, the image capture sequence may subsequently be stopped or halted according to one or more end conditions, such as expiration of a predetermined time period, failure to detect further changes in sequential images, or closing of the door 128.

Separate from or in addition to the captured images, weight sensor 210 and controller 150 may be configured to detect the mass or weight of objects supported on drawer assembly 200, such as on the horizontal platform 220 or within storage drawers 142, 212 (e.g., according to a predetermined scheduled or in tandem with the image capture sequence). Such detections may generate a captured mass load.

From the captured images and mass load(s), controller 150 may automatically attempt to recognize items (e.g., stored items, such as food, or non-stored items such as a user appendage, a shelf, a movable drawer, etc.) within the field of view for the image module 160. As is understood, recognizing such items, may be performed by edge matching, divide-and-conquer search, greyscale matching, histograms of receptive field responses, or another suitable routine (e.g., executed at the controller 150 based on one or more captured images from image module 160). recognition may include or attempt to estimate the identification (e.g., what type of food or object is recognized) or quantity (e.g., number of discrete units, volume, or mass) of the stored item.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet comprising an inner liner defining a chilled chamber;

a door being rotatably hinged to the cabinet to provide selective access to the chilled chamber;

an image module mounted to the cabinet and having a field of view within the chilled chamber; and a drawer assembly disposed within the field of view of the image module, the drawer assembly comprising an assembly frame supported on the inner liner, a slidable drawer movably attached to the assembly frame to move relative thereto, and a plurality of weight sensors mounted on the assembly frame apart from the slidable drawer to detect a weight of one or more objects received on the drawer assembly, wherein the plurality of weight sensors are fixed relative to the inner liner and laterally spaced apart from the slidable drawer.

2. The refrigerator appliance of claim 1, wherein the inner liner comprises one or more lateral mounts disposed below a top end of the assembly frame, wherein the plurality of weight sensors are supported on the one or more lateral mounts.

3. The refrigerator appliance of claim 1, wherein the inner liner comprises a base wall disposed below the drawer assembly, wherein the plurality of weight sensors are supported on the base wall.

4. The refrigerator appliance of claim 1, wherein one or more of the plurality of weight sensors are held between the assembly frame and the inner liner.

5. The refrigerator appliance of claim 1, wherein the slidable drawer is a first drawer, and wherein the drawer assembly further comprises a second drawer movably attached to the assembly frame apart from the first drawer to move relative to the assembly frame and first drawer.

6. The refrigerator appliance of claim 5, wherein the second drawer is laterally spaced apart from the first drawer.

7. The refrigerator appliance of claim 5, wherein the second drawer is vertically spaced apart from the first drawer.

8. The refrigerator appliance of claim 1, wherein the drawer assembly further comprises a horizontal platform attached to the assembly frame above the slidable drawer.

9. The refrigerator appliance of claim 1, wherein the plurality of weight sensors comprises a strain gauge, force sensitive resistor, hydraulic tube, or pneumatic tube extending transversely along the assembly frame.

10. The refrigerator appliance of claim 1, wherein the image module is disposed above the drawer assembly.

11. A refrigerator appliance comprising:

a cabinet comprising an inner liner defining a chilled chamber;

a door being rotatably hinged to the cabinet to provide selective access to the chilled chamber;

an image module mounted to the cabinet and having a field of view within the chilled chamber; and a drawer assembly disposed within the field of view of the image module, the drawer assembly comprising an assembly frame supported on the inner liner, a first slidable drawer movably attached to the assembly frame to move relative thereto, a second slidable drawer movably attached to the assembly frame apart from the first slidable drawer to move relative to the assembly frame and first slidable drawer, a horizontal platform attached to the assembly frame above the first and second slidable drawers, and a plurality of weight sensors mounted on the assembly frame apart from the first and second slidable drawers to detect a weight of one or more objects received on the drawer assembly, wherein the plurality of weight sensors are fixed relative to the inner liner and laterally spaced apart from the first and second slidable drawers.

12. The refrigerator appliance of claim 11, wherein the inner liner comprises one or more lateral mounts disposed below a top end of the assembly frame, wherein the plurality of weight sensors are supported on the one or more lateral mounts.

13. The refrigerator appliance of claim 11, wherein the inner liner comprises a base wall disposed below the drawer assembly, wherein the plurality of weight sensors are supported on the base wall.

14. The refrigerator appliance of claim 11, wherein one or more of the plurality of weight sensors are fixed relative to the inner liner.

15. The refrigerator appliance of claim 14, wherein the second slidable drawer is laterally spaced apart from the first slidable drawer.

16. The refrigerator appliance of claim 14, wherein the second slidable drawer is vertically spaced apart from the first slidable drawer.

17. The refrigerator appliance of claim 11, wherein the plurality of weight sensors comprises a strain gauge, force sensitive resistor, hydraulic tube, or pneumatic tube extending transversely along the assembly frame.

18. The refrigerator appliance of claim 11, wherein the image module is disposed above the drawer assembly.

* * * * *